US007197264B2

(12) United States Patent
Umemoto et al.

(10) Patent No.: US 7,197,264 B2
(45) Date of Patent: Mar. 27, 2007

(54) IMAGE FORMING APPARATUS

(75) Inventors: Hiroaki Umemoto, Neyagawa (JP); Noritoshi Hagimoto, Toyohashi (JP); Kuniya Matsuura, Toyohashi (JP); Akira Hirota, Okazaki (JP); Naotoshi Kawai, Toyokawa (JP); Kentaro Katori, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 42 days.

(21) Appl. No.: 11/020,251

(22) Filed: Dec. 27, 2004

(65) Prior Publication Data

US 2006/0083549 A1 Apr. 20, 2006

(30) Foreign Application Priority Data

Oct. 18, 2004 (JP) ..... 2004-303105

(51) Int. Cl.
*G03G 15/30* (2006.01)

(52) U.S. Cl. ..... 399/149; 399/353; 399/354; 399/357; 399/358; 399/359

(58) Field of Classification Search ..... 399/149, 399/353, 354, 357, 358, 359, 115, 150
See application file for complete search history.

(56) References Cited

U.S. PATENT DOCUMENTS 4,752,810 A * 6/1988 Schmidlin et al. ..... 399/354
6,215,971 B1 * 4/2001 Sakoh et al. ..... 399/159

FOREIGN PATENT DOCUMENTS

| | | |
|---|---|---|
| JP | 10-003197 A | 1/1998 |
| JP | 10-254219 A | 9/1998 |
| JP | 2001-255799 | 9/2001 |
| JP | 2002-372878 | 12/2002 |

* cited by examiner

*Primary Examiner*—David M. Gray
*Assistant Examiner*—Ruth N. LaBombard
(74) *Attorney, Agent, or Firm*—Morrison & Foerster LLP

(57) ABSTRACT

It is intended to provide an image forming apparatus capable of conducting charge adjustment of post-transfer residual toner appropriately by securing a contact area of a temporarily-collecting member and an electrode, without applying excessive deformation load to the temporarily-collecting member. There are arranged a brush roller for temporarily collecting post-transfer residual toner, and an electrode of which inwardly-curved face being in contact with the brush roller in a toner charge apparatus. Thereby, charged-in-opposite-polarity toner, out of post-transfer residual toner, is collected by the brush roller, polarity of the toner is reversed to original polarity, and then, returned to a photosensitive drum. The inner face of the electrode, i.e., a contact face of the electrode and the brush roller is formed in an inwardly-curved face. Thereby, a large contact area and light pushing force of the electrode to the brush roller can go together.

16 Claims, 7 Drawing Sheets

IMAGE FORMING APPARATUS

This application is based on Application No. 2004-303105 filed in Japan, contents of which are hereby incorporated by reference.

BACKGROUND OF THE INVENTION

1. Field of the Invention

The present invention relates to an image forming apparatus for forming an image wherein a toner image is formed on its toner image carrier and then, transferred onto a to-be-transferred body. More particularly, it relates to an image forming apparatus equipped with a temporarily-collecting member which temporarily collects post-transfer residual toner on the toner image carrier and expels the toner later.

2. Description of Related Art

An electro-photographic-type image forming apparatus forms a toner image on a toner image carrier by taking steps of charge, exposure, and development. The toner image is transferred onto a to-be-transferred body and fixed. In this way, an image is formed. There remains some toner on the toner image carrier after transfer of a toner image. The residual toner is termed as post-transfer residual toner, herein. The post-transfer residual toner is obstacle to charge and exposure. Furthermore, post-transfer residual toner distributes unevenly leaving last toner image pattern before transferred. Therefore, post-transfer residual toner causes noises to next image formation.

Therefore, there has been devised an image forming apparatus equipped with a cleaner at a position after image transfer and before charge as disclosed in JP Laid-open Patent Publication No. 2001-255799. However, in case a cleaner is employed, collected post-transfer residual toner becomes waste toner. This is unfavorable in terms of environmental preservation. Therefore, there has been proposed an image forming apparatus without a cleaner such as disclosed in JP Laid-open Patent Publication No. 2002-372878. In such an image forming apparatus without a cleaner, post-transfer residual toner is collected by a developer. For surely collecting post-transfer residual toner by a developer, it is required to control charge quantity of the post-transfer residual toner. For that purpose, the image forming apparatus disclosed in the Publication No. 2002-372878 is equipped with a temporarily-collecting member (brush roll) which temporarily collects post-transfer residual toner and gives it back to an image carrier at a position after image transfer and before charge. The temporarily-collecting member is applied with an appropriate level of voltage. Therefore, post-transfer residual toner of which charge quantity is adjusted should be returned to the image carrier.

However, the above-mentioned conventional image forming apparatus without a cleaner has had the following problem. That is, adequate charge adjustment cannot always be done by just applying voltage to the temporarily-collecting member and its case. Subsequently, there occur problems such that toner accumulates in the temporarily-collecting member, charge quantity of toner returned to the image carrier is not appropriate, and the like. For resolving such problems, it has been attempted that the temporarily-collecting member is made to get contact with an appropriate electrode and voltage is applied thereto. However, as long as a contact area of the temporarily-collecting member and the electrode is not taken to some extent, a sufficient effect of it cannot be expected. On the other hand, making a contact area large causes a situation that an electrode is pushed in the temporarily-collecting member strongly. As a result, deformation and wear-out occur at the temporarily-collecting member, which are problematic.

SUMMARY OF THE INVENTION

The present invention has been made in order to solve the foregoing problems which the above mentioned conventional image forming apparatus has had. It is an object of the present invention to provide an image forming apparatus capable of conducting charge adjustment of post-transfer residual toner appropriately by securing a contact area of a temporarily-collecting member and an electrode, without applying excessive deformation load to the temporarily-collecting member.

According to a first aspect of the present invention, there is provided an image forming apparatus comprising: a toner image carrier; a transferring section which transfers toner image on the toner image carrier to a to-be-transferred body; a temporarily-collecting member which rotates around its axis in contact with the toner image carrier, thereby temporarily collecting post-transfer residual toner on the toner image carrier and expelling collected toner to the toner image carrier; an electrode member which is in contact with the temporarily-collecting member at position excepting the position where the temporarily-collecting member is in contact with the toner image carrier; and a voltage applier which applies voltage to the electrode member, wherein a contact face of the electrode member which is in contact with the temporarily-collecting member is an inwardly curved face.

According to a second aspect of the present invention, there is provided an image forming apparatus comprising: a toner image carrier; a transferring section which transfers toner image on the toner image carrier to a to-be-transferred body; a temporarily-collecting member which rotates around its axis in contact with the toner image carrier, thereby temporarily collecting post-transfer residual toner on the toner image carrier and expelling collected toner to the toner image carrier; an electrode member which is in contact with the temporarily-collecting member at position excepting the position where the temporarily-collecting member is in contact with the toner image carrier; and a voltage applier which applies voltage to the electrode member, wherein the electrode member contains a first and a second contact faces in contact with the temporarily-collecting member at upstream and at downstream of rotation direction of the temporarily-collecting member.

According to a third aspect of the present invention, there is provided an image forming apparatus comprising: a toner image carrier; a transferring section which transfers toner image on the toner image carrier to a to-be-transferred body; a temporarily-collecting member which rotates around its axis in contact with the toner image carrier, thereby temporarily collecting post-transfer residual toner on the toner image carrier and expelling collected toner to the toner image carrier; a first and a second electrodes which are in contact with the temporarily-collecting member at upstream and at downstream positions of rotation direction of the temporarily-collecting member excepting the position where the temporarily-collecting member is in contact with the toner image carrier; and a voltage applier which applies voltage to the first and the second electrodes.

According to these aspects of the present invention, post-transfer residual toner remaining on the face of the toner image carrier reaches a contact point of the toner image carrier and the temporarily-collecting member. The toner is collected temporarily by the temporarily-collecting member. Post-transfer residual toner on temporarily-collecting member passes through the contact section of the temporarily-collecting member and the electrode along rotation of the temporarily-collecting member. Now, post-transfer residual toner comes very close to the electrode, and charge state of the toner is adjusted. The post-transfer residual toner reaches a contact point of the toner image carrier and the temporarily-collecting member along further rotation of the temporarily-collecting member. The toner is expelled from the temporarily-collecting member to the toner image carrier there.

In this stage, the contact section of the temporarily-collecting member and the electrode is large. This is because the contact face of the electrode is an inwardly curved face, because the electrode contains the first and the second contact faces at upstream and at downstream, or because the electrode is divided into the first and the second electrodes at upstream and at downstream. Therefore, charge adjustment of post-transfer residual toner by the electrode is made for sure. On the other hand, pushing force of the electrode into the temporarily-collecting member is not so strong. Therefore, wear-out and deformation of the temporarily-collecting member go little.

BRIEF DESCRIPTION OF DRAWINGS

For a better understanding of the present invention, reference is made to the following detailed description of the invention, just in conjunction with the accompanying drawings in which.

DETAILED DESCRIPTION OF PREFERRED EMBODIMENTS

Figure 1:
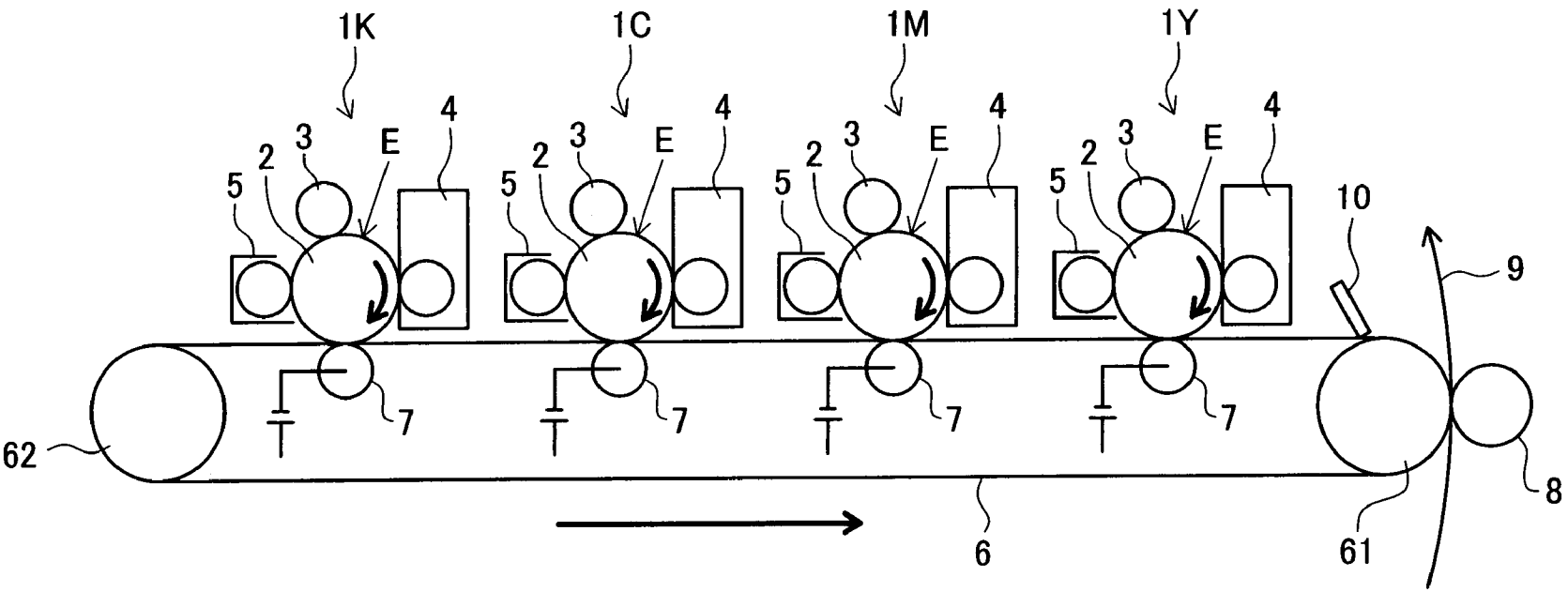
FIG. 1 is a schematic structural diagram of an image forming apparatus directed to present embodiment.

There will be described a preferred embodiment in detail by referring to drawings. An image forming apparatus of present embodiment is schematically structured as shown in FIG. 1. The image forming apparatus directed to the present embodiment is a tandem-type full-color image forming apparatus. That is, the image forming apparatus of the present embodiment includes a transfer belt 6. The transfer belt 6 is put on rollers 61 and 62 and arranged to rotate counterclockwise in FIG. 1. Along the transfer belt 6, image forming sections 1K, 1C, 1M, and 1Y for respective colors, namely, black, cyan, magenta, and yellow, are arranged. This is to superimpose respective colored toner images on the transfer belt 6. Furthermore, there is arranged a secondary transfer roller 8 with facing to the roller 61. This is to transfer a superimposed toner image on the transfer belt 6 onto a sheet 9. Furthermore, there is also arranged a cleaning blade 10 for eliminating residual toner on the transfer belt 6.

Structure of the respective image forming sections 1K, 1C, 1M, and 1Y are same. That is, each of the image forming sections 1K, 1C, 1M, and 1Y has a photosensitive drum 2. Around each photosensitive drum 2, there are arranged a charger 3, a developer 4, and a toner charge apparatus 5. The developer 4 is dedicated for negative charged toner. Furthermore, a primary transfer roller 7 is arranged at a position of facing to a photosensitive drum 2 via a transfer belt 6. Rotation direction of the photosensitive drum is a normal direction with reference to rotation direction of the transfer belt 6, i.e., clockwise in FIG. 1. Therefore, the position of the toner charge apparatus 5 is at downstream of the primary transfer roller 7 and at upstream of the charger 3 with reference to rotation direction of the photosensitive drum 2. Furthermore, an exposure position E is provided at a position of downstream of the charger and of upstream of the developer 4.

Figure 2:
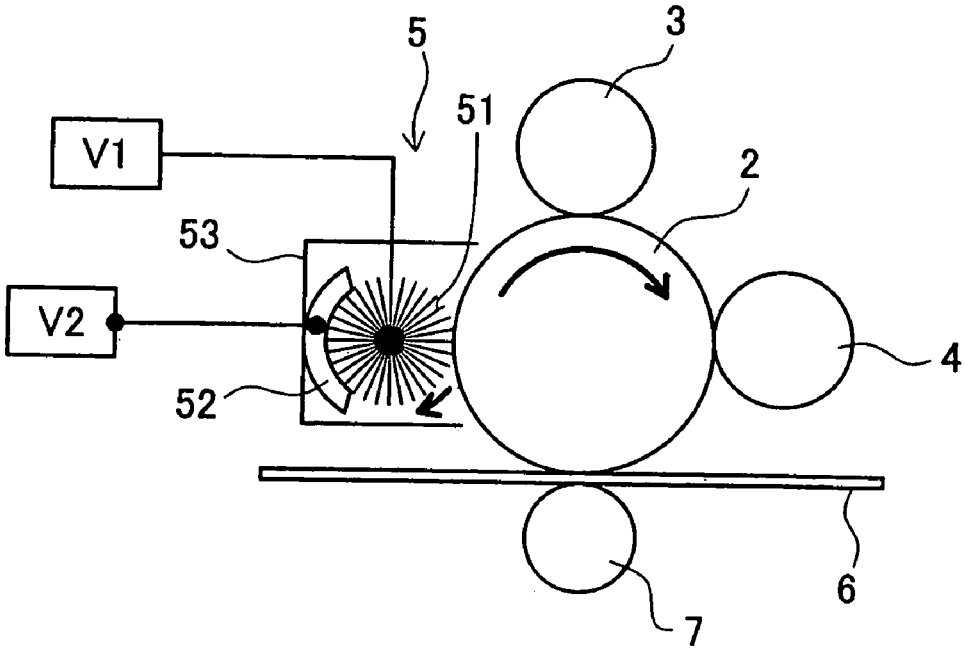
FIG. 2 is a diagram showing structure of an image forming section of the image forming apparatus directed to the present embodiment.

There will be further described on the toner charge apparatus 5 by referring to FIG. 2. The toner charge apparatus 5 consists of a brush roller 51, an electrode 52, and a case 53. The brush roller 51 is formed of many conductive needle-like things planted at a center of an axis. The brush roller 51 is flexible and has a generally cylindrical shape. The brush roller 51 is in contact with the photosensitive drum 2 at a point of downstream of the primary transfer roller 7 and of upstream of the charger 3, looked from rotation direction of the photosensitive drum 2. The brush roller 51 rotates around the axis during operation. Whichever rotation direction may be possible for the brush roller 51, with reference to rotation of the photosensitive drum 2. In description hereinafter, the brush roller 51 is assumed to rotate in a counter direction with reference to of the photosensitive drum 2 as long as not specifically noted. Bias voltage V1 is applied to the brush roller 51.

The electrode 52 is arranged inside the case 53 together with the brush roller 51. Inner face of the electrode 52, i.e., the face at the side of the brush roller 51 is an inwardly curved face meeting with shape of the brush roller 51. The brush roller 51 is in contract with almost the entirety of the inner face softly. Therefore, a contact region of the brush roller 51 and the electrodes 52 occupies almost half of the entire periphery of the brush roller 51. Bias V2 is applied to the electrode 52.

There will be described a setting example of bias voltage V1 and bias voltage V2. The following conditionings are required for this bias setting. Firstly, the brush roller 51 is required to be able to collect post-transfer residual toner, especially, of which charge polarity is reversed (termed as "charged-in-opposite-polarity toner", hereinafter), on the photosensitive drum 2. This is requirement for bias voltage V1. Furthermore, charge polarity of charged-in-opposite-polarity toner collected by the brush roller 51 is required to get back to original polarity. This is requirement for bias voltage V2. Furthermore, toner on the brush roller 51 is required not to move on the electrode 52. This is requirement for relation of bias voltage V1 and bias voltage V2. Furthermore, toner of which charge polarity is adjusted on the brush roller 51 is required to be expelled on the photosensitive drum 2. This is requirement for bias voltage V1.

Here, bias setting which satisfies the following conditioning is applied. First of all, bias voltage V1 applied to the brush roller 51 is superimposing of AC and DC, and the followings are satisfied.

DC component Vdc=−100V (vs. voltage of photosensitive drum 2)

AC component Vpp=300V frequency f=100 Hz waveform: rectangular wave (duty 50%)

That is, here is satisfied an equation, V1=Vdc+Vpp. Bias voltage V2 at the electrode 52 is DC and level of it is 500V (vs. voltage of photosensitive drum 2).

There will be described operation of the image forming apparatus directed to the present embodiment. In the image forming apparatus of the present embodiment, each colored toner image is formed on each photosensitive drum 2 provided for each of the image forming sections 1K, 1C, 1M, and 1Y. Each colored toner image is transferred onto the transfer belt 6 by each primary transfer roller 7 provided for each of the image forming sections 1K, 1C, 1M, and 1Y. Thereby, four-colored toner images are superimposed on the transfer belt 6. Thus superimposed toner image is transferred onto the sheet 9 by the secondary transfer roller 8. The sheet 9 which has had transfer of the superimposed toner image is processed and fixed. As a result, a color image is formed on the sheet 9.

A toner image is formed at each of the image forming sections 1K, 1C, 1M, and 1Y as follows. Firstly, a photosensitive layer, the face of the photosensitive body 2, is charged to predetermined potential. An electrostatic latent image is written on the photosensitive layer charged to predetermined potential, at the exposure position E. Then, the electrostatic latent image is developed by the developer 4, whereby, a toner image is formed. The toner image thus formed is transferred onto the transfer belt 6 by the primary transfer roller 7.

At this stage, some extent of toner remains on the face of the photosensitive drum 2 even after passing of the transfer point by the primary transfer roller 7. For the post-transfer residual toner, the following processing is made by the toner charge apparatus 5. Post-transfer residual toner reaches a contact point of the photosensitive drum 2 and the brush roller 51 along rotation of the photosensitive drum 2. When reaching the contract point, the post-transfer residual toner is collected by the brush roller 51. Bias voltage V1 between the photosensitive drum 2 and the brush roller 51 set as described above. Therefore, at the contact position, electric field attracting charged-in-opposite-polarity toner on the photosensitive drum 2 is applied to the brush roller 51. So, it is mainly charged-in-opposite-polarity toner out of post-transfer residual toner that is collected by the brush roller 51.

Post-transfer residual toner collected by the brush roller 51 reaches a contact section of the brush roller 51 and the electrode 52 along rotation of the brush roller 51. Therefore, charge state of toner on the brush roller 51 is adjusted by bias voltage V2 at the electrode 52. Specifically, charge polarity of charged-in-opposite-polarity toner is reversed to its original charge polarity. Charge adjustment of most of charged-in-opposite-polarity toner is made by passing through the contact section of the brush roller 51 and the electrodes 52 along rotation of the brush roller 51. Toner on the brush roller 51 of which charge adjustment is done reaches the contract point of the photosensitive drum 2 and the brush roller 51 again along rotation of the brush roller 51. This time, the toner is expelled from the brush roller 51 to the photosensitive drum 2. This is because the above-described electric field is applied to the point. Therefore, charge-adjusted toner is attracted from the brush roller 51 to the photosensitive drum 2.

Charge adjustment by the toner charge apparatus 5 is thus made at a position of after-transfer and of before-charge for post-transfer residual toner on the photosensitive drum 2. That is, there remains little charged-in-opposite-polarity toner on the photosensitive drum 2 after passing the toner charge apparatus 5. Therefore, post-transfer residual toner on the photosensitive drum 2 is in charged state almost same as the state when supplied to development at developer 4. Furthermore, since post-transfer residual toner passes the toner charge apparatus 5, pattern of an original toner image thereon is cleared. That is, diffusion is done. Post-transfer residual toner on the photosensitive drum 2 under such state moves to a charge position of the charger 3 and goes further. Therefore, post-transfer residual toner will never be obstacle to charge and exposure. Furthermore, toner especially applied to a white portion is collected in the developer 4 at the time of development. This is because charge adjustment is made. Therefore, post-transfer residual toner does not cause image noises.

Collection of post-transfer residual toner by the brush roller 51 is made just temporarily. Therefore, toner does not accumulate on the brush roller 51. Accordingly, the toner charge apparatus 5 is not a so-called cleaner. Exactly, this is application of cleaner-less process to each of the image forming sections 1K, 1C, 1M, 1Y directed to the present embodiment.

Advantage unique to the image forming apparatus of the present embodiment lies in shape of the electrode 52. As described, the electrode 52 has an inwardly curved face meeting with shape of the brush roller 51. The inwardly curved face is used as a contact face to the brush roller 51. Therefore, there can be obtained advantages in comparison with a case that a contact face to the brush roller 51 is plane (see FIG. 3).

Figure 3:
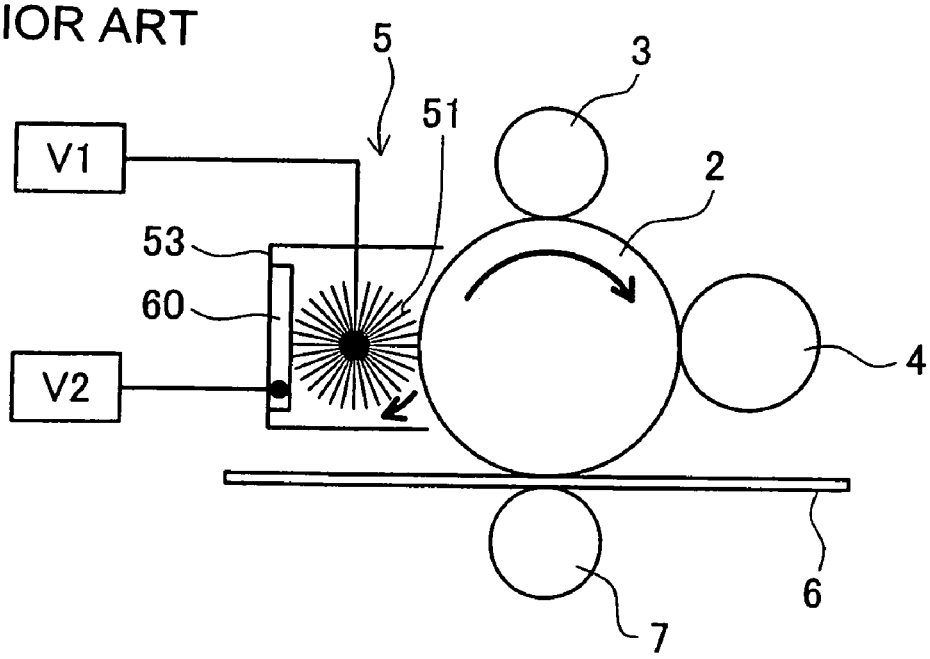
FIG.3 PRIOR ART
FIG. 3 is a diagram showing structure of an image forming section directed to a comparative example.

That is, a contact area of the brush roller 51 and the electrodes 52 is taken large. Therefore, charge adjustment of toner by bias voltage V2 at the electrode 52 is made for sure. Meanwhile, contact of the brush roller 51 and the electrode 52 is soft. Therefore, pushing force of the electrode 52 into the brush roller 51 is weak. Therefore, wear-out and deformation of the brush roller 51 can go little. Furthermore, adhesion of toner on the electrode 52 is little. In case a plane electrode 60 such as shown in FIG. 3 is used, large contact area and soft contact cannot be realized concurrently. However, the present embodiment realizes both large contact area and soft contact by applying the electrode 52 with inwardly curved face.

Figure 4:
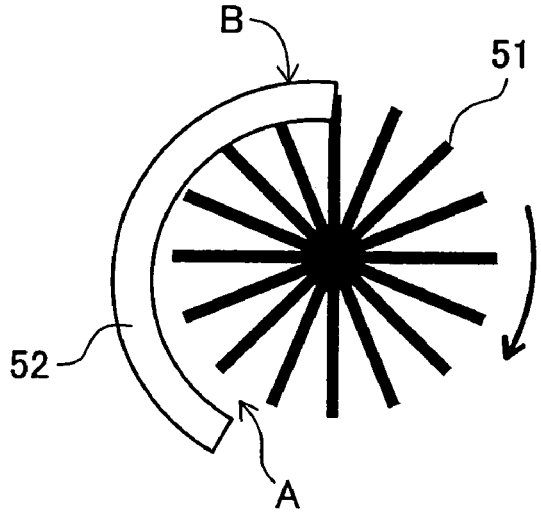
FIG. 4 is an illustrative diagram showing other example of electrode arrangement.

In FIG. 2, whole contact face of the electrode 52 comes to contact with the brush roller 51 with almost uniform pushing force. However, not restricted to such arrangement, arrangement such as shown in FIG. 4 may be applicable. In FIG. 4, contact face of the brush roller 51 and the electrode 52 deviates from each other's center. Thereby, at a portion A, the most upstream of the contact face of the electrode 52, the brush roller 51 and the contact face are not contact with each other. Instead, a halfway and following of the contact face is contact with the brush roller 51. With even such arrangement, a large contact face and soft contact can go together in better state in comparison with the case of the plane electrode 60 in FIG. 3. Furthermore, shock is never applied to the brush roller 51 at beginning of contact section of the brush roller 51 and the electrode 52. Therefore, escape of toner from the brush roller 51 can be restrained to less extent. Furthermore, viewed from brush roller 51's side, pushing-in of the electrode 52 gets larger gradually after contact with the electrode 52 begins. In other words, a distance from the center of the brush roller 51 to the contact face of the electrode 52 becomes narrower as it goes toward downstream of rotation direction of the brush roller 51.

It is to be noted that with arrangement way of FIG. 4, pushing force of the electrode 52 to the brush roller 51 around the end portion of the contact face (position B in FIG. 4) is somewhat stronger than the case of FIG. 2. However, it is weaker than pushing force of FIG. 3 where the contact area is made large forcedly by employing the plane electrode 60. Therefore, the case of FIG. 4 does not cause wear-out and deformation of the brush roller 51. Incidentally, effect of dispersing toner is stronger than the case FIG. 2. This is because there is unevenness of pushing force depending on rotation directional points within the contact range of the brush roller 51 and the electrode 52. That is, toner is dispersed at portions of strong pushing force, due to the evenness of pushing force.

Figure 5:
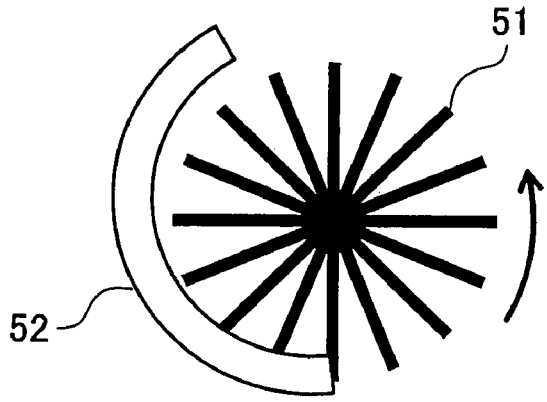
FIG. 5 is an illustrative diagram showing other example of electrode arrangement.
Figure 6:
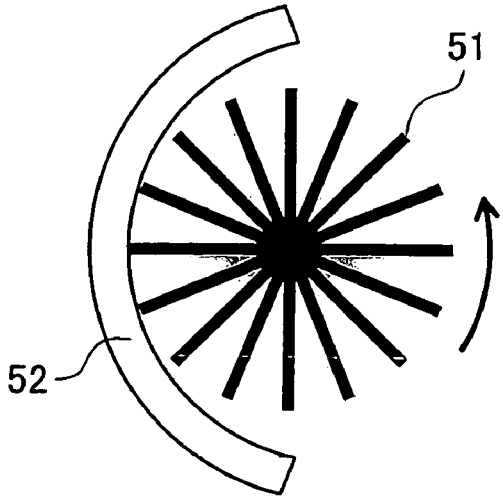
FIG. 6 is an illustrative diagram showing other example of electrode arrangement.

In case the brush roller 51 rotates in a normal direction with reference to rotation of the photosensitive drum 2, arrangement is such like as shown in FIG. 5. Furthermore, regardless of rotation direction of the brush roller 51, arrangement may be such like as shown in FIG. 6. In case of FIG. 6, internal diameter of the contact face of the electrode 52 is made larger than peripheral diameter of the brush roller 51. For that reason, uneven pushing force is secured within the contact range of the brush roller 51 and the electrode 52. It is to be noted that the case 53 and the like is not shown in FIG. 4 through FIG. 6 (same to FIG. 11, FIG. 12 to be described later).

Figure 7:
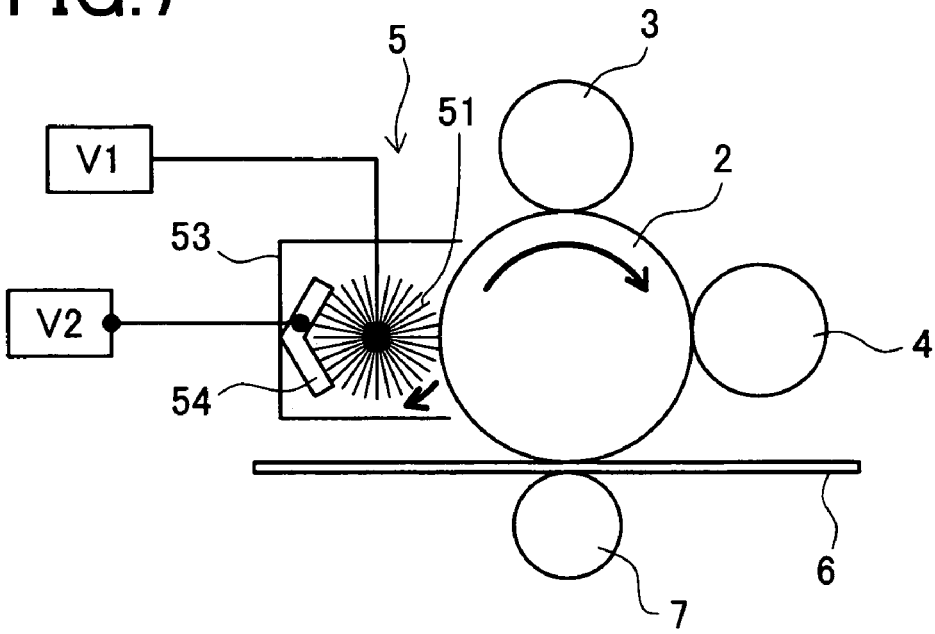
FIG. 7 is an illustrative diagram showing other example of electrode's shape.
Figure 8:
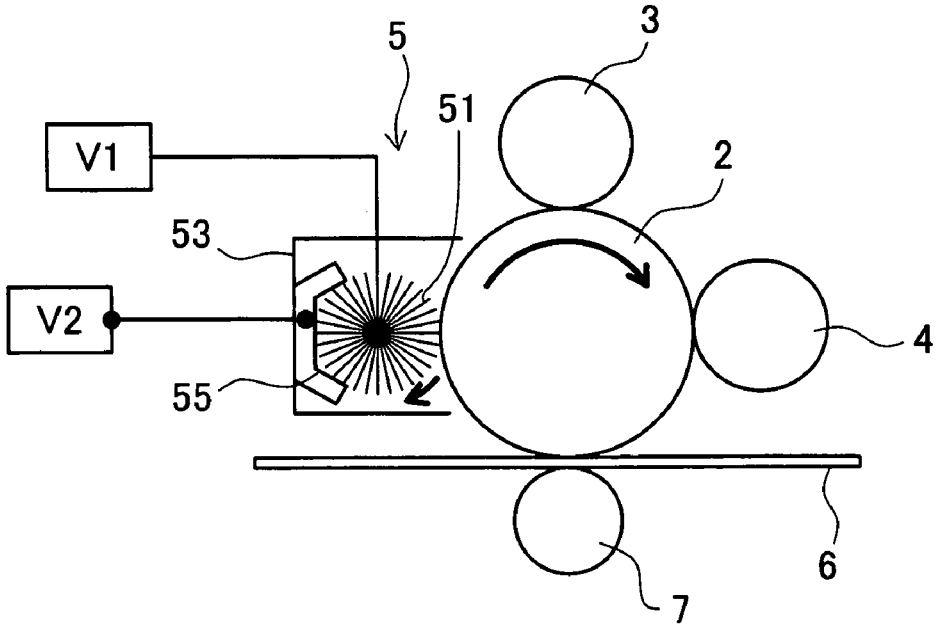
FIG. 8 is an illustrative diagram showing other example of electrode's shape.
Figure 9:
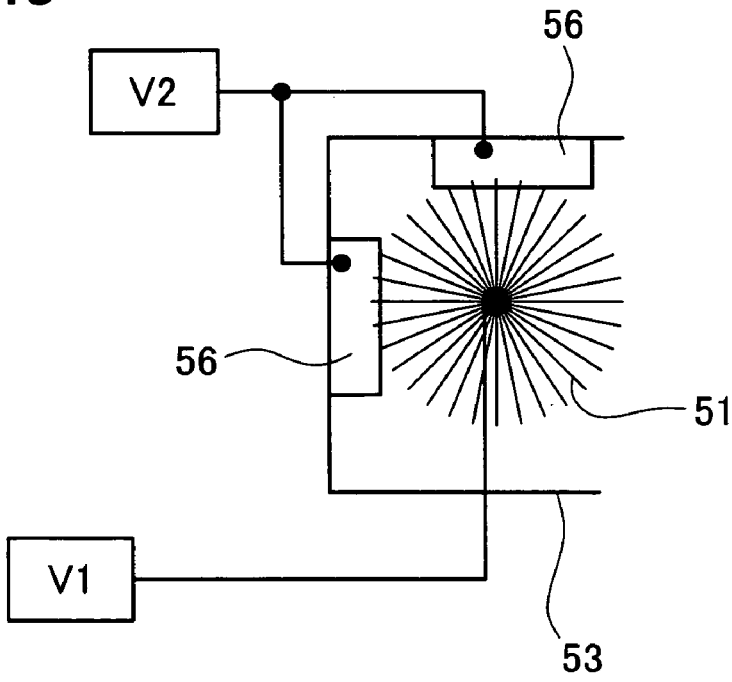
FIG. 9 is an illustrative diagram showing other example of electrode arrangement.
Figure 10:
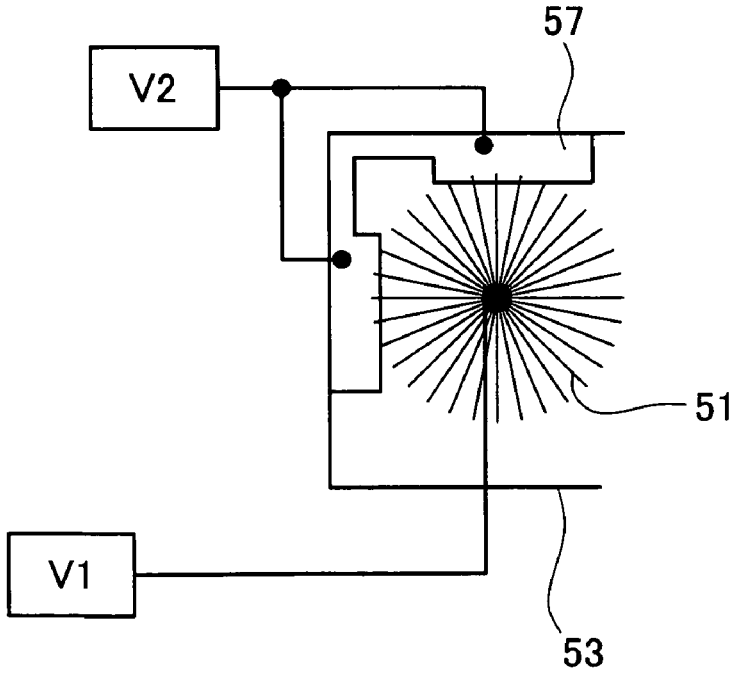
FIG. 10 is an illustrative diagram showing other example of electrode's shape.

Furthermore, an electrode contact with the brush roller 51 in the case 53 may be such as shown in FIG. 7 and FIG. 8. In FIG. 7, an electrode 54 has two contact faces. In FIG. 8, an electrode 55 has three contact faces. In these two cases, contact faces of the electrodes 54 and 55 are arranged from upstream to downstream along rotation direction of the brush roller 51. With such featured electrodes, large contact area and soft contact can go together in better way than the case of FIG. 3. Same effect can be obtained by arranging plural electrodes 56, 56 on upstream and downstream along rotation direction of the brush roller 51, as shown in FIG. 9. An electrode 57 having plural contract faces as shown in FIG. 10 may be applicable, also. What is shown in FIG. 10 is substantially same as the case of FIG. 7.

Figure 11:
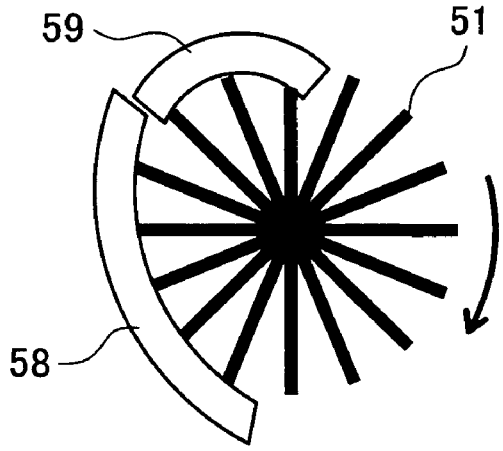
FIG. 11 is an illustrative diagram showing other example of electrode arrangement and electrode's shape.

Furthermore, in case plural electrodes are used, shape of contact face may be made different among electrodes. In FIG. 11, curvature of a contact face is made different. That is, an electrode 59 at downstream side for rotation direction of the brush roller 51 has larger curvature in comparison with an electrode 58 at upstream side. With such curvatures, entrance of contract area of an electrode (electrode 58) and the brush roller 51 is made to get contact softly. Therefore, little toner is scraped at entrance. At the exit of the contact area (electrode 59), the brush roller 51 and the electrode 59 come to contact with each other more firmly. Therefore, charge adjustment of toner by bias voltage V2 for the electrode 59 can be done for sure. Furthermore, clearance of toner pattern is secured, as well.

Figure 12:
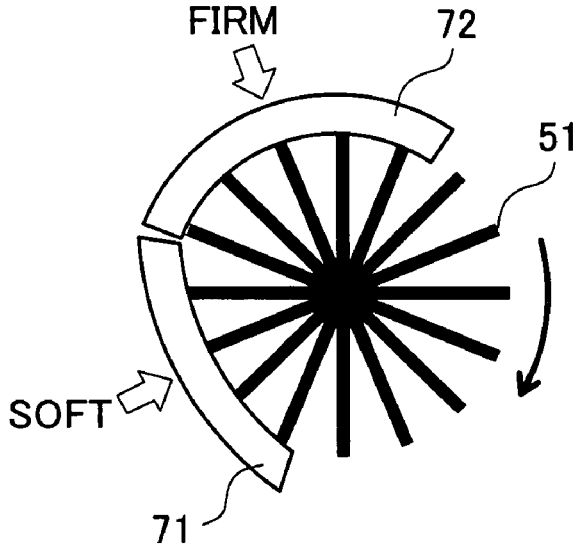
FIG. 12 is an illustrative diagram showing other example of electrode arrangement and electrode's shape.

Alternatively, pushing force may be made different among electrodes. In FIG. 12, an electrode 72 at downstream side comes to contact with the brush roller 51 with stronger pushing force than an electrode 71 at upstream side. That is, a distance from center of the brush roller 51 to an electrode 72 is shorter than a distance from center of the brush 51 to an electrode 71. Subsequently, an effect same as FIG. 11 can be obtained.

Not to mention, in cases of FIG. 7 through FIG. 10, curvature difference as shown in FIG. 11 is applicable. An electrode or a contact face at upstream side may be made plane and an electrode or a contact face at downstream side may be made an inwardly-curved face. Similarly, for the cases of FIG. 7 through FIG. 10, pushing force difference as shown in FIG. 12 is applicable. In that case, relation between distances from the center of the brush roller 51 to electrode or contact faces, i.e., which distance smaller/larger is, may be determined by comparison of minimum or average values of the distances.

Figure 13:
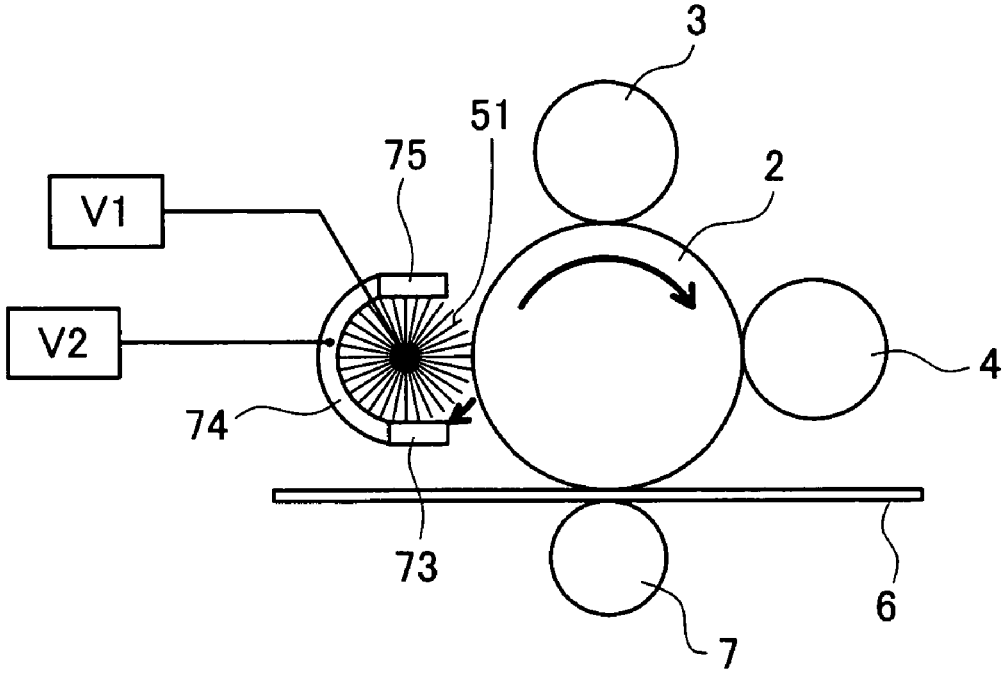
FIG. 13 is an illustrative diagram showing other example of electrode arrangement and electrode's shape.

Furthermore, as shown in FIG. 13, an electrode may be combined with a case. In FIG. 13, plane electrodes 73, 75 and curved-face electrode 74 are combined to be formed in a U-shape. Inside of it, the brush roller 51 is arranged. Thereby, the plane electrodes 73, 75 and the curve-face electrode 74 also work as a case. For such structure, relation of the plane electrode 73 and the curved-faced electrode 74 corresponds to curvature difference of afore-mentioned upstream and downstream. Furthermore, the afore-mentioned pushing force difference may be applied to relation of the plane electrode 73 and the curved-faced electrode 74 or that of the curved-face electrode 74 and the plane face 75. For the case of FIG. 13, a leading electrode is a plane electrode 73. Therefore, shock at beginning of contact does not occur similar to the cases of FIG. 4 through FIG. 6.

It is not necessary that all of "73", "74", and "75" in FIG. 13 are electrodes. It is possible that one or two of them are electrodes and rest of it (them) is/are insulators. In that case, a part of a case is constituted by an electrode.

As described, in the image forming apparatus of the present embodiment, each of the image forming sections 1K, 1C, 1M, and 1Y applies cleaner-less process wherein charge adjustment of post-transfer residual toner on the photosensitive drum 2 is done by toner charge apparatus 5 and the adjusted toner is transmitted to the charger 3. The toner charge apparatus 5 is equipped with the electrode 52 which has an inwardly curved face which comes to contact with the brush roller 51. Alternatively, the brush roller 51 and an electrode come to contact with each other at plural portions which are upstream and downstream for rotation direction of the brush roller 51. Thereby, a contact area of an electrode and the brush roller 51 is secured large with not too strong pushing force of an electrode to the brush roller 51. There is thus realized an image forming apparatus wherein toner charge adjustment can be done for sure without wear-out and deformation of the brush roller 51.

Furthermore, there are other aspects of the image forming apparatus wherein shape of contact face of an electrode and/or pushing force of an electrode to the brush roller 51 is/are not made uniform. To be more specific, it is such structured that curvature and/or pushing force becomes large as rotation of the brush roller 51 goes from upstream to downstream. Thereby, such structure prevents toner from escaping from the brush roller 51 at initial contact with an electrode. Especially, it is better to be structured that an electrode and the brush roller 51 does not come to contact with each other at front portion of upstream side. Furthermore, there can be obtained toner diffusion effect. Still further, since an electrode is combined with a case, the number of composing members is reduced.

Meanwhile, the present embodiment is a just mere exemplification, never restricting the present invention to any particular one. Therefore, naturally the present invention may be improved or modified in various ways within a range not departing from the gist. For example, the present embodiment describes a tandem-type full-color image forming apparatus as shown in FIG. 1, however it is applicable to a monochrome image forming apparatus. Furthermore, the inventive image forming apparatus may be a copier, a printer, a facsimile, a multi function peripherals, and the like. Furthermore, although a brush roller is employed as a temporarily-collecting member in the present embodiment, a sponge roller or a rubber roller may be applicable as long as it is made of electrically conductive material.

According to the present invention, there can be provided an image forming apparatus capable of conducting charge adjustment of post-transfer residual toner appropriately by securing a contact area of a temporarily-collecting member and an electrode, without applying excessive deformation load to the temporarily-collecting member.

What is claimed is:

1. An image forming apparatus, comprising:

a toner image carrier;

a transferring section to transfer a toner image on the toner image carrier to a to-be-transferred body;

a temporarily-collecting member, having an axis, to rotate around the axis in contact with the toner image carrier, thereby temporarily collecting post-transfer residual toner on the toner image carrier and expelling collected toner to the toner image carrier;

an electrode member which is in contact with the temporarily-collecting member at a position other than the position where the temporarily-collecting member is in contact with the toner image carrier; and a voltage applier to apply voltage to the electrode member, wherein a contact face of the electrode member which is in contact with the temporarily-collecting member is an inwardly curved face, the contact face of the electrode member contains a first position upstream of a rotation direction of the temporarily-collecting member and a second position downstream of a rotation direction of the temporarily-collecting member, wherein the first position and the second position are within a contact range of the temporarily-collecting member, and a pushing force at the second position is stronger than a pushing force at the first position.

2. An image forming apparatus, comprising:

a toner image carrier;

a transferring section to transfer a toner image on the toner image carrier to a to-be-transferred body;

a temporarily-collecting member, having an axis, to rotate around the axis in contact with the toner image carrier, thereby temporarily collecting post-transfer residual toner on the toner image carrier and expelling collected toner to the toner image carrier;

an electrode member which is in contact with the temporarily-collecting member at a position other than the position where the temporarily-collecting member is in contact with the toner image carrier; and a voltage applier to apply voltage to the electrode member, wherein a contact face of the electrode member which is in contact with the temporarily-collecting member is an inwardly curved face, the contact face of the electrode member contains a first position upstream of a rotation direction of the temporarily-collecting member and a second position downstream of a rotation direction of the temporarily-collecting member, wherein the first position and the second position are within a contact range of the temporarily-collecting member, and a curvature of the second section is larger than a curvature of the first section.

3. An image forming apparatus, comprising: a toner image carrier;

a transferring section to transfer a toner image on the toner image carrier to a to-be-transferred body;

a temporarily-collecting member, having an axis, to rotate around the axis in contact with the toner image carrier, thereby temporarily collecting post-transfer residual toner on the toner image carrier and expelling collected toner to the toner image carrier;

an electrode member which is in contact with the temporarily-collecting member at a position other than the position where the temporarily-collecting member is in contact with the toner image carrier; and a voltage applier to apply voltage to the electrode member, wherein a contact face of the electrode member which is in contact with the temporarily-collecting member is an inwardly curved face, and the contact face of the electrode member is apart from the temporarily-collecting member at the most upstream portion of a rotation direction of the temporarily-collecting member.

4. An image forming apparatus according to claim 3, wherein the electrode member is combined with a case in which the temporarily-collecting member is arranged.

5. An image forming apparatus according to claim 3, wherein cleaner-less process is applied.

6. An image forming apparatus comprising:

a toner image carrier;

a transferring section which transfers toner image on the toner image carrier to a to-be-transferred body;

a temporarily-collecting member which rotates around its axis in contact with the toner image carrier, thereby temporarily collecting post-transfer residual toner on the toner image carrier and expelling collected toner to the toner image carrier;

an electrode member which is in contact with the temporarily-collecting member at position excepting the position where the temporarily-collecting member is in contact with the toner image carrier; and a voltage applier which applies voltage to the electrode member, wherein the electrode member contains a first and a second contact faces in contact with the temporarily-collecting member at upstream and at downstream of rotation direction of the temporarily-collecting member.

7. An image forming apparatus according to claim 6, wherein pushing force of the second contact face to the temporarily-collecting member is stronger than that of the first contact face.

8. An image forming apparatus according to claim 6, wherein the second contact face is an inwardly curved face while the first contact face is a plane face or an inwardly curved face having smaller curvature than that of the second contact face.

9. An image forming apparatus according to claim 6, wherein the electrode member contains a third contact face in contact with the temporarily-collecting member at downstream of rotation direction of the temporarily-collecting member to the second contact face.

10. An image forming apparatus according to claim 6, wherein the electrode member is combined with a case in which the temporarily-collecting member is arranged.

11. An image forming apparatus according to claim 6, wherein cleaner-less process is applied.

12. An image forming apparatus comprising:

a toner image carrier;

a transferring section which transfers toner image on the toner image carrier to a to-be-transferred body;

a temporarily-collecting member which rotates around its axis and is in contact with the toner image carrier, thereby temporarily collecting post-transfer residual toner on the toner image carrier and expelling collected toner to the toner image carrier;

a first and a second electrodes which are in contact with the temporarily-collecting member at upstream and at downstream positions of rotation direction of the temporarily-collecting member excepting the position where the temporarily-collecting member is in contact with the toner image carrier; and a voltage applier which applies voltage to the first and the second electrodes.

13. An image forming apparatus according to claim 12, wherein pushing force of the second electrode to the temporarily-collecting member is stronger than that of the first electrode.

14. An image forming apparatus according to claim 12, wherein a contact face of the second electrode is an inwardly curved face while a contact face of the first electrode is a plane face or an inwardly curved face having smaller curvature than that of the contact face of the second electrode.

15. An image forming apparatus according to claim 12, wherein the first and the second electrodes are combined with a case in which the temporarily-collecting member is arranged.

16. An image forming apparatus according to claim 12, wherein cleaner-less process is applied.

* * * * *